US006000155A

United States Patent [19]

Kinser, Jr.

[11] Patent Number: 6,000,155

[45] Date of Patent: Dec. 14, 1999

[54] GARMENT AND LAUNDRY PRESS

[75] Inventor: James A. Kinser, Jr., Jefferson County, Ky.

[73] Assignee: Cissell Manufacturing Company, Louisville, Ky.

[21] Appl. No.: 09/094,736

[22] Filed: Jun. 15, 1998

[51] Int. Cl.[6] ..... D06F 71/06

[52] U.S. Cl. ..... 38/40

[58] Field of Search ..... 38/26, 33, 35, 38/37, 40, 41, 17, 16, 21, 22, 36, 38, 43; 92/192

[56] References Cited

U.S. PATENT DOCUMENTS

| | | | |
|---|---|---|---|
| 2,971,281 | 2/1961 | Neckel | 38/41 |
| 3,490,159 | 1/1970 | Radford et al. | 38/35 |
| 4,280,290 | 7/1981 | Andersson | 38/31 |
| 4,399,624 | 8/1983 | Ward | 38/27 |
| 4,475,738 | 10/1984 | Eicher | 277/206 |
| 4,774,875 | 10/1988 | Amshoff | 92/122 |
| 4,843,745 | 7/1989 | Oberley | 38/34 |
| 5,040,453 | 8/1991 | Eicher et al. | 92/122 |
| 5,065,535 | 11/1991 | Gill et al. | 38/22 |

*Primary Examiner*—Ismael Izaguirre
*Attorney, Agent, or Firm*—Polster, Lieder, Woodruff & Luchessi

[57] ABSTRACT

A garment and laundry press including a relatively movable press buck and press head one of which is connected to pivotal arm structure at one thereof with the other end of said pivotal arm structure being connected to a longitudinally extending fluid pressure driven rotatable actuator member.

13 Claims, 4 Drawing Sheets

GARMENT AND LAUNDRY PRESS

BACKGROUND OF THE INVENTION

The present invention relates to laundry machinery apparatus and more particularly to an improved apparatus for imparting relative motion for engagement and disengagement or closing and opening of a cooperating press buck and press head of a garment and laundry press machine.

A number of garment and laundry press machines for moving a press head into and out of engagement with a press buck have long been known in the garment and laundry machinery art, attention being directed to such U.S. Pat. No. 2,971,281, issued to E. N. Neckel on Feb. 14, 1961; U.S. Pat. No. 3,490,159 issued to D. L. Radford et. al. on Jan. 20, 1970; U.S. Pat. No. 4,280,290, issued to Ake Anderson on Jul. 28, 1981; U.S. Pat. No. 4,399,624, issued to D. B. Ward on Aug. 23, 1983; and, U.S. Pat. No. 4,843,745, issued to G. L. Oberly on Jul. 4, 1989. For the most part, these and other head press activating mechanisms of prior garment and laundry pressing machinery have used standard air and steam circuitry to activate pivotal arm linkages, such linkages being connected to press heads which, in turn, reciprocally move into and out of pressing engagement with press bucks with steam being connected to the press.

These past garment and laundry pressing arrangements have been comparatively costly in the manufacture of numerous intricate parts and the assembly of these parts into operating machinery and often have presented problems in both maintenance and in parts replacement. Further, comparatively complex indexing machinery, such as disclosed in U.S. Pat. No. 5,065,535, issued to S. S. Gill on Nov. 19, 1991, has been required to move the press heads through a comparatively limited radius angle, which in turn restricts machinery use in pressing large garment and laundry articles and in the refined pressing of small garment and laundry articles which often require ready accessibility to the press buck for manual hand manipulation.

The present invention provides a comparatively inexpensive, economical and efficient garment and laundry press structure, recognizing and effectively modifying and utilizing rotary actuator structure heretofore known in the prior art. In this regard, attention is further directed to long known U.S. Pat. No. 4,475,738, issued to F. C. Eicher et. al. on Oct. 9, 1984; U.S. Pat. No. 4,774,875, issued to H. J. Amshoff, III on Oct. 4, 1988; and, U.S. Pat. No. 5,040,453, issued to F. Eicher et. al. on Aug. 20, 1991. All three of these known patents disclose a pressure driven vane actuator disposed in a fixed chamber defining house with the vane actuator being keyed to a shaft to rotate the shaft for powering purposes. The present invention recognizes and avails itself of the structural teachings of these patents, modifying and utilizing the known structure in a new and unobvious manner to bring about a unique garment and laundry press arrangement heretofore unknown in the art.

Various other feature of the present invention will become obvious to one skilled in the garment and laundry press art upon reading the disclosure herein.

BRIEF SUMMARY OF THE INVENTION

More particularly the present invention provides a garment and laundry press comprising: a support structure having press buck means and press head means mounted thereon in cooperative longitudinally extending movable relationship; arm means pivotally mounted on the support structure to pivot the press buck means and the press head mean relative to each other in garment pressing engagement and, disengagement; and rotating actuating means longitudinally extending parallel the press buck means and press head means in rotatably mounted connected relationship with the arm means to selectively and uniformly actuate the arm means to pivot the press buck means and press head means in garment pressing engagement and disengagement. In addition, the present invention recognizes and utilizes known structure to adjust the height and leveling of the overall garment and laundry press arrangement in a manner heretofore unknown in the prior art.

It is to be understood that various changes can be made by one skilled in the art in one of more of the several parts of the unique and novel laundry press arrangement disclosed herein without departing from the scope or spirit of the present invention.

BRIEF DESCRIPTION OF THE DRAWINGS

Referring to the drawings which disclose one advantageous embodiment of the present invention and a modification thereto.

DETAILED DESCRIPTION OF THE DRAWING

Figure 1:
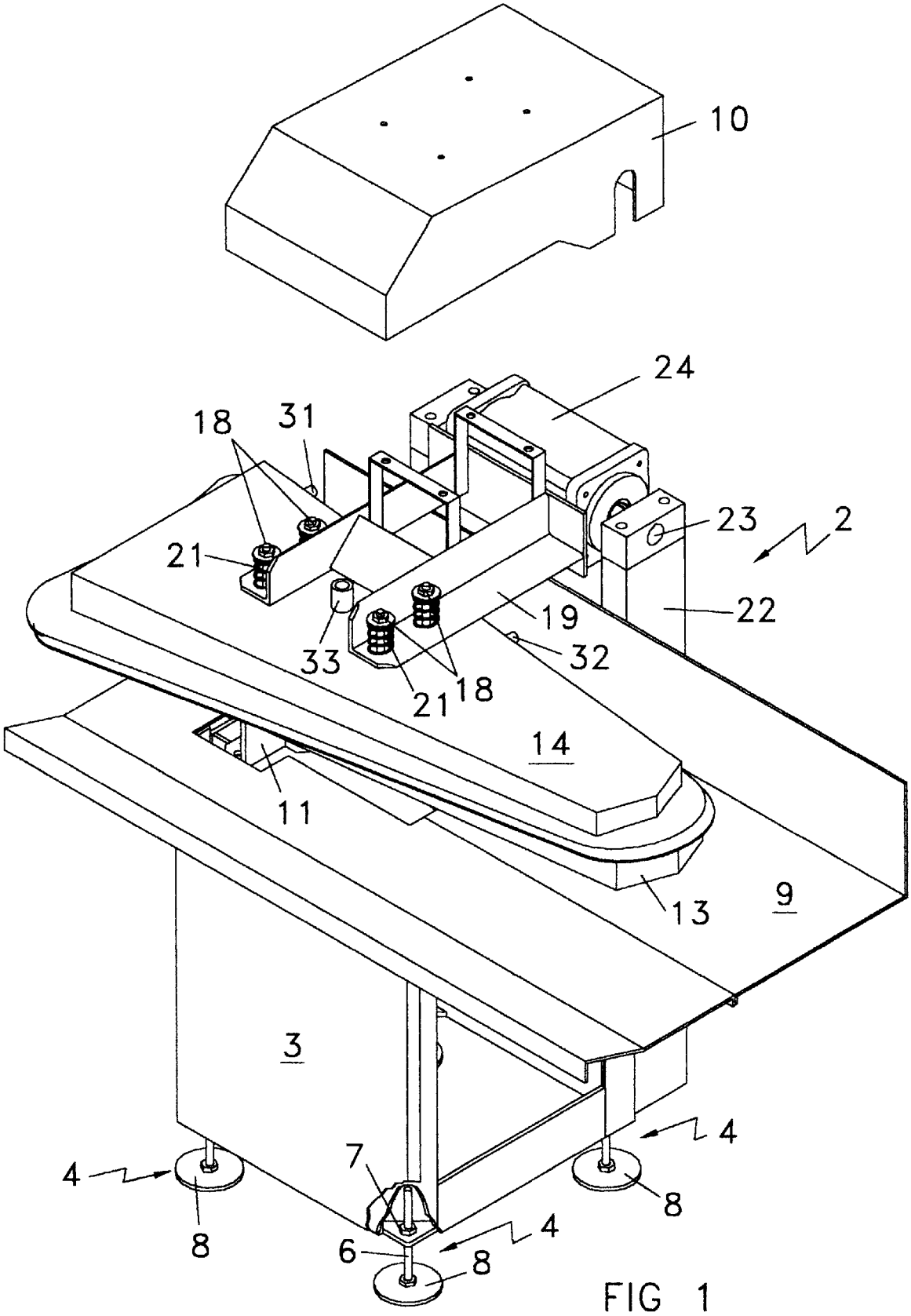
FIG. 1 is an isometric, particularly broken away view of the inventive garment and laundry press with the hood or cover portion removed thereabove and the press head and press buck in closed position.

As can be seen in FIGS. 1–5 of the drawings, the inventive garment and laundry press, here shown as garment and laundry press 2, includes a rectangular cabinet-like support structure 3 having unique height and level adjustable spaced base feet 4 at the cabinet corners. As can be more readily seen in FIG. 3 of the drawings, each base foot 4 includes an individually threaded, vertically disposed and externally threaded bolt 6 which engages with an internally threaded nut 7 fixed to a cabinet corner, the bolts allowing height and level adjustment of the cabinet support structure 3. Suitable foot or floor rest pads 8 in the form of flat discs are mounted on the distal ends of adjustable bolts 6. Thus, with this unique support structure arrangement, it is possible to readily adjust the support structure which supports the press buck and head in an appropriately leveled and height operating position. A cover 10 is shown above the press head.

Figure 2:
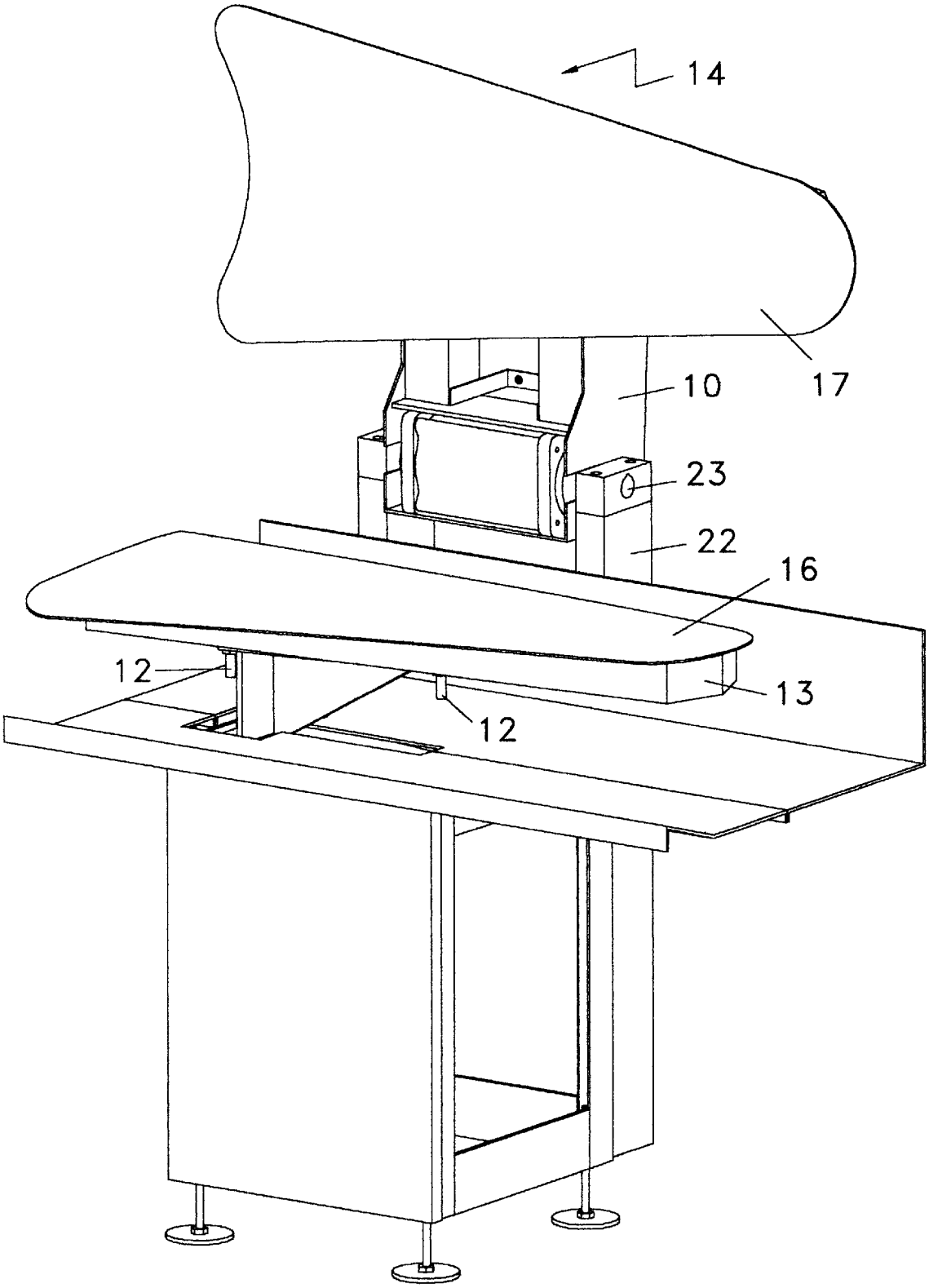
FIG. 2 is an isometric view similar to that of FIG. 1 with the hood portion in place and with the press head and press buck in open position.
Figure 3:
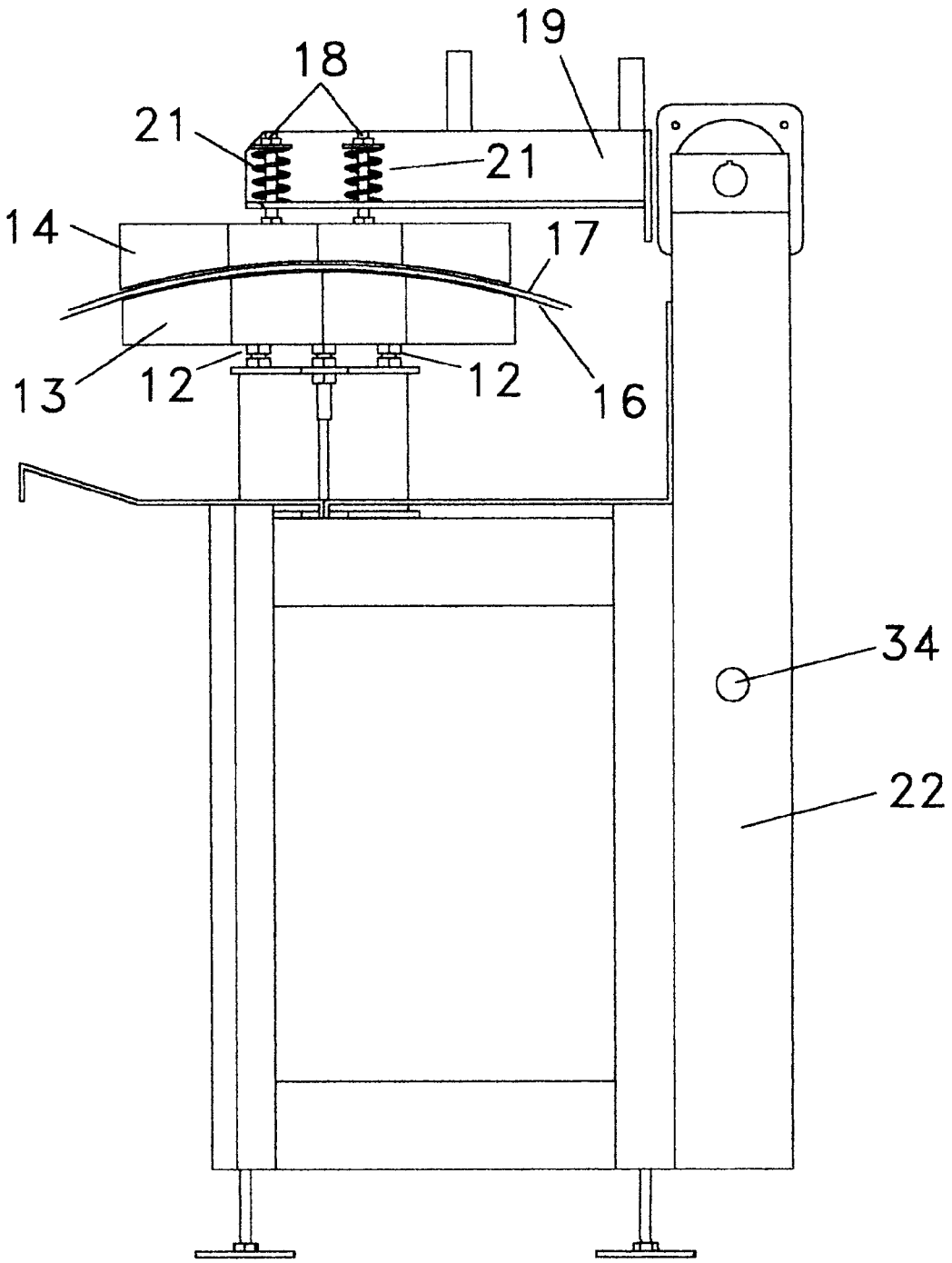
FIG. 3 is an enlarged side view of the laundry press of FIG. 1 with the press head and press buck in closed position.

As can be seen in FIGS. 1–3 of the drawings, cabinet-like support housing 3 has fixedly mounted on the top surface thereof a horizontal, longitudinally extending table top 9. Table top 9, in turn, has a press buck support 11 fixed thereon which includes adjustable supports in the form of turnscrews and nut assemblies 12, for further adjusting horizontally and longitudinally extending press buck 13 (FIGS. 2 and 3). Positioned above press buck 13 for cooperable engaged and disengaged relationship therewith-or from respective closed and opened garment pressing positions-is mating longitudinally extending press head 14. As also can be seen in FIGS. 2 and 3, suitable longitudinally extending, curved and mating steam deflection guards and shields 16 and 17 are mounted on the press buck 13 and press head 14 respectively to serve as guards and to guide and deflect steam when the press buck 13 and press head 14 are in pressing relationship.

As can be seen in FIGS. 1–3 of the drawings, press head 14 is fastened by pairs of spaced externally threaded bolt and nut assemblies 18 at the corresponding distal ends of a pair of spaced, parallel longitudinally extending pivotal arms 19 of right cross-section, the bolts extending through corresponding leg portions of arms 19. Each bolt 18 includes a helical coil spring 21 positioned there around to allow for adjustable resilient engagement of press head 14 with press buck 13.

Figures 4, 5, 6:
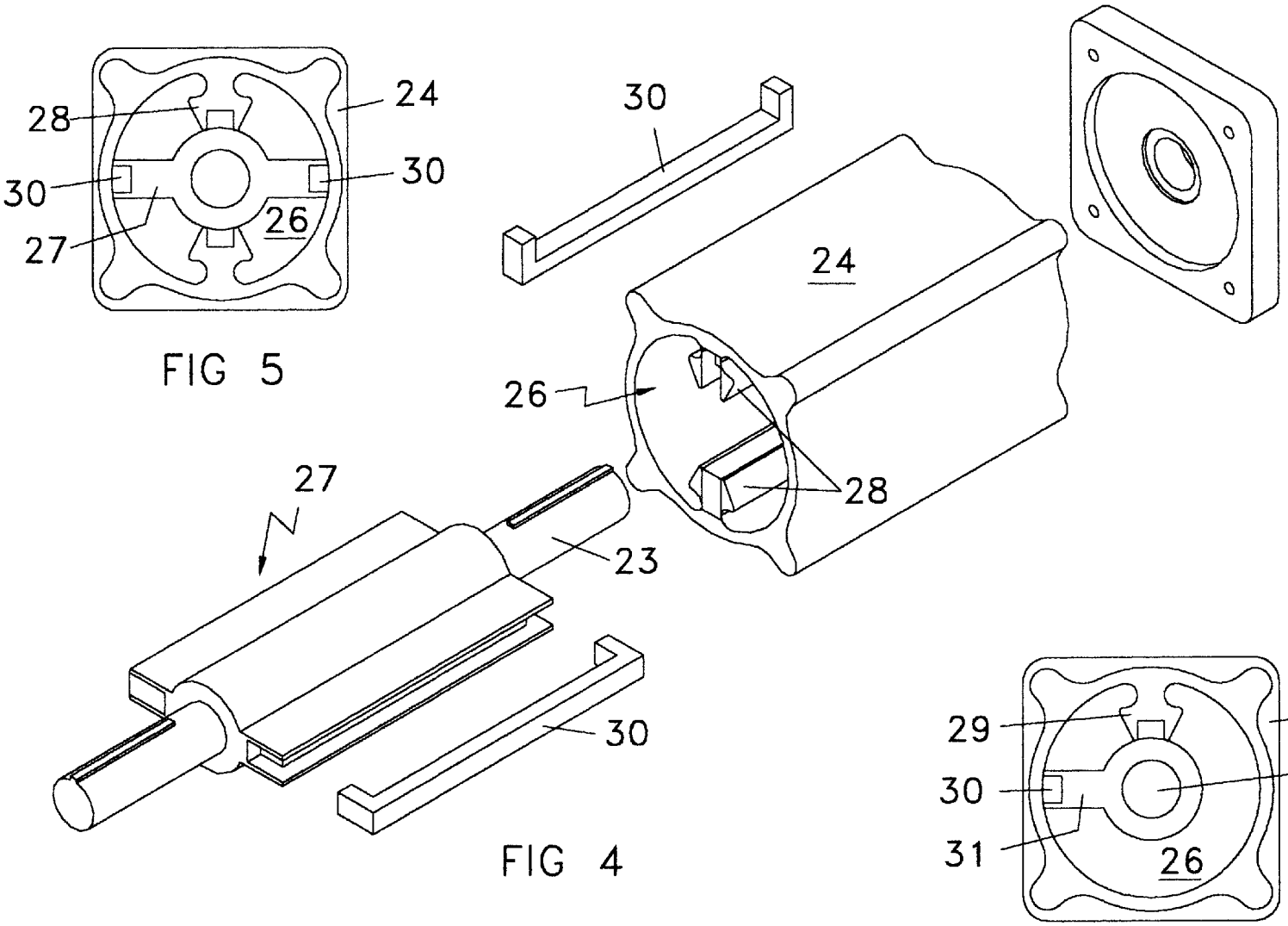
FIG. 4 is an enlarged exploded isometric view of the rotary actuator of FIGS. 1–3.
FIG. 5 is a schematic cross-section of a double vane actuator such as disclosed in FIG. 4.
FIG. 6 is a schematic cross-section of a modified single vane actuator which can be employed in place of the double vane actuator to obtain a larger radial angle of opening.

A pair of spaced, parallel, longitudinally and vertically extending arms 22 are fastened at corresponding base ends to cabinet support structure 13 and a horizontally extending cylindrical shaft 23 (FIG. 4) is fastened at its opposed extremities to the distal ends of support arms 22. Fixed shaft 23 serves to rotatably support the end extremities of a longitudinally extending chamber defining housing 24 which defines a longitudinally extending internal chamber 26 therein. It is to be noted that the ends extremities of chamber defining housing 24 are not only rotatably mounted on fixed support shaft 23 through suitable shaft bearings but that appropriate seals also are provided to gear the longitudinally extending chamber 26 defined by rotatable housing 24. As can be seen in FIGS. 4 and 5 of the drawings a high torque, longitudinally extending double vane actuator 27 with end seals 30 is rotatably mounted on the fixed shaft 23 within longitudinally extending chamber 26 defined by rotatable housing 24 on fixed shaft 23. When pneumatic pressure is introduced into chamber 26, the vane actuator 27 abuts against internal rotatable housing 24 projections 28 extending inwardly in spaced opposed relation from the internal wall of chamber defining housing 24 into the defined chamber 26. This engagement or abutment of the double vane 27 against spaced, opposed internal housing projections 28 rotates housing 24 through an angle of up-to at least approximately ninety-four degrees (94°). In this regard and as can be seen in FIGS. 1–3 of the drawings, the rotatable chamber defining housing 24 has fixed thereto at corresponding opposed extremities thereof, those corresponding ends removed from the distal ends of right angle arms 19 which distal ends in turn, are fastened to press head 14; as above described. Thus, press head 14 can be advanced in an incremental, pressure controlled fashion through a radius angle of up-to at least ninety four degrees (94°) (FIG. 5).

Referring to FIG. 6 of the drawings, it can be seen that by modifying the rotating actuator to include only one internal projection 29 from housing 24 extending into internally defined chamber 26 along with a single vane 31 rotating about shaft 23, the rotating radial angle can be extended up-to approximately two hundred and seventy-four degrees (274°). However, with such a single vane actuator (FIG. 6), the turning torque would be less than the turning torque from that of a double vane actuator (FIG. 5) and, as a consequence, increased pneumatic pressure might be required to obtain desirable engaging pressure of press head and press buck.

Referring to FIG. 1 of the drawings, steam inlet 31, steam outlet 32 and steam feed valve inlet 33 can be seen associated with the press head 4 and pneumatic air inlet 34 is shown in one of the support arms 22, with the air outlet being in the other of the tow support arms (not shown). However, it is to be understood that anyone of a number of suitable valve and solenoid controlled pneumatic and steam circuits can be utilized internally and externally with the garment and laundry press structure 2 as above described to provide the necessary relative operating motions between the press head and press buck and, to provide the necessary steaming conditions. Since such circuitry is not an integral part of the present invention an example of such circuitry is disclosed herewith in order to simplify the unique disclosure herein.

The invention claimed is:

1. A garment and laundry press comprising: a support structure having a press buck and a press head mounted thereon in cooperative longitudinally extending movable relationship; an arm pivotally mounted on said support structure to pivot said press head relative said press buck in garment pressing engagement and disengagement; and, a rotating actuator longitudinally extending parallel said press buck and said press head in rotatably mounted connected relationship with said arm to selectively actuate said arm to pivot said press head relative said press buck uniformly in garment and laundry pressing engagement and disengagement, said rotating actuator including a first member fixed to said support structure and a second member rotatably mounted in spaced chamber defining relation about said first fixed member; and a pressure arrangement cooperative therebetween to selectively move said rotatable second member relative said first fixed member in opposed directions.

2. The garment and laundry press of claim 1, said arm connected at one end to said press head and at the opposite end to said rotating actuator.

3. The garment and laundry press of claim 1, said support structure having a leveling and height adjustment member therefor.

4. The garment and laundry press of claim 1, said pivotal arm including spaced parallel arms fastened at corresponding first ends to opposed extremities of said rotatably mounted second member of said rotating actuator and at corresponding distal ends to said press head.

5. The garment and laundry press of claim 1, and a resilient mounting member cooperative with said pivotal arm.

6. The garment and laundry press of claim 1, said first fixed member comprising a shaft fixed to said support structure and said second member comprising a longitudinally extending chamber defining housing rotatably mounted on said fixed shaft in sealed relationship therewith with said pressure arrangement including at least one vane disposed in said chamber to rotate about said shaft and abuttingly engage said chamber defining housing and rotate the same in response to vane rotating pressure.

7. The garment and laundry press of claim 6, said pressure arrangement including a fluid pressure source capable of selectively introducing and removing fluid pressure from said defined chamber to selectively provide vane rotating pressure.

8. The garment and laundry press of claim 6, said shaft being fixed at opposed ends to a pair of longitudinally extending arms forming a part of said support frame.

9. The garment and laundry press of claim 6, said longitudinally extending chamber defining housing having spaced parallel arms fastened at corresponding first ends to opposed extremities of said chamber defining housing and at corresponding distal ends to aid longitudinally extending press head.

10. The garment and laundry press of claim 6, said vane disposed in said chamber comprising a high torque, double vane actuator capable of abutting and incrementally rotating said longitudinally extending chamber defining housing through an angle of up to at least ninety-four degrees (94°).

11. The garment and laundry press of claim 6, said vane disposed in said chamber comprising a low torque single vane actuator capable of incrementally rotating said housing through and angle up to at least two hundred and seventy-four degrees (274°).

12. The garment and laundry press of claim 6, said longitudinally extending chamber defining housing including spaced parallel arms fastened at corresponding first ends to opposed sealing extremities of said rotatable chamber defining housing and at corresponding distal ends by bolts surrounded by spring loaded helical springs to provide uniform resilient pressure along the longitudinal axis of said press head.

13. A garment and laundry press comprising: a housing support structure having height and level adjustable base feet and a horizontal and longitudinally extending table top mounted thereon; a horizontal and longitudinally extending press back fixedly mounted on said table top; an adjustable, longitudinally extending press head positioned above said press buck to be in cooperative engageable and disengageable garment pressing relationship therewith, said press head being fastened by spaced, threaded bolts at the corresponding distal ends of a pair of spaced, parallel, longitudinally extending right angle arms, each of said spaced threaded bolts, including a helical coil spring positioned there around to allow for adjustable resilient engagement of said press head with said press buck; a pair of spaced, parallel, longitudinally and vertically extending support arms fastened at their base corresponding ends to said support structure; a horizontally extending cylindrical shaft fastened at opposed extremities to the corresponding distal ends of said vertically extending support arms; a longitudinally extending chamber defining housing rotatably mounted at opposed ends in sealed relationship with said horizontally fixed shaft; a high torque, double vane actuator rotatably mounted on said shaft within said chamber of said housing, said vane actuator being capable of abutting and incrementally rotating said longitudinally extending chamber defining housing through an angle of up to at least ninety-four degrees (94°), said housing having fixed thereto the corresponding ends removed from said distal ends of said pair of right angle arms fastened to said press head; and, a pneumatic controlled pressure source arranged to incrementally rotate said double vane actuator and said chamber defining housing about said horizontally extending fixed cylindrical shaft.

* * * * *